US010914141B2

(12) United States Patent
Koli

(10) Patent No.: US 10,914,141 B2
(45) Date of Patent: Feb. 9, 2021

(54) SCREEN JACKET TERMINATION CONFIGURATION AND METHOD

(71) Applicant: Jai Kishan Koli, Houston, TX (US)

(72) Inventor: Jai Kishan Koli, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 154 days.

(21) Appl. No.: 15/915,920

(22) Filed: Mar. 8, 2018

(65) Prior Publication Data

US 2019/0277117 A1 Sep. 12, 2019

(51) Int. Cl.
*E21B 43/08* (2006.01)

(52) U.S. Cl.
CPC ..... *E21B 43/088* (2013.01); *E21B 43/08* (2013.01)

(58) Field of Classification Search
CPC ..... E21B 43/088; E21B 43/08
See application file for complete search history.

(56) References Cited

U.S. PATENT DOCUMENTS 2,905,251 A * 9/1959 Church ..... E21B 43/082 166/228
3,958,634 A * 5/1976 Smith ..... B01D 29/48 166/233
8,176,634 B2 * 5/2012 Bonner ..... E21B 43/084 29/896.62
9,757,813 B2 * 9/2017 Everritt ..... B23K 11/255

* cited by examiner

*Primary Examiner* — David J Bagnell
*Assistant Examiner* — Jonathan Malikasim
(74) *Attorney, Agent, or Firm* — Cantor Colburn LLP

(57) ABSTRACT

A screen jacket termination configuration includes a base pipe, a rib disposed at the base pipe, a wire wrapped about the base pipe and rib to form a screen jacket, and a termination strip wrapped about the base pipe and rib and disposed between wraps of the wire. A method for terminating a screen jacket includes disposing a termination strip between adjacent wraps of a screen jacket, the termination strip closing a space between the screen jacket and a base pipe at an end of the screen jacket such that any gap between the termination strip and the base pipe is less than a gauge of the screen jacket.

3 Claims, 3 Drawing Sheets

SCREEN JACKET TERMINATION CONFIGURATION AND METHOD

BACKGROUND

In resource recovery arts, it is often desirable to filter produced fluids emanating from formations that bear them. To this end, sand screens are common in the industry. Sand screens commonly include a base pipe with ribs longitudinally disposed there around and a wire wrapped about the ribs. In order to ensure the wire stays where placed, end rings are commonly disposed at the termination of the screen jacket and welded in place. While the method works well, it requires manpower and processes that amount to cost in production.

Greater efficiency is always welcomed where viable products can be attained and so the art is always receptive to new methods and apparatus that achieve that result.

SUMMARY

A screen jacket termination configuration including a base pipe, a rib disposed at the base pipe, a wire wrapped about the base pipe and rib to form a screen jacket, and a termination strip wrapped about the base pipe and rib and disposed between wraps of the wire.

A screen jacket termination configuration including a base pipe, a rib disposed at the base pipe, a wire wrapped about the base pipe and rib to form a screen jacket, the wire having a first gap from the base pipe and being gradually reduced in a dimension of the gap from the base pipe from a more central position on the screen jacket to an end of the screen jacket.

A method for terminating a screen jacket includes disposing a termination strip between adjacent wraps of a screen jacket, the termination strip closing a space between the screen jacket and a base pipe at an end of the screen jacket such that any gap between the termination strip and the base pipe is less than a gauge of the screen jacket.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
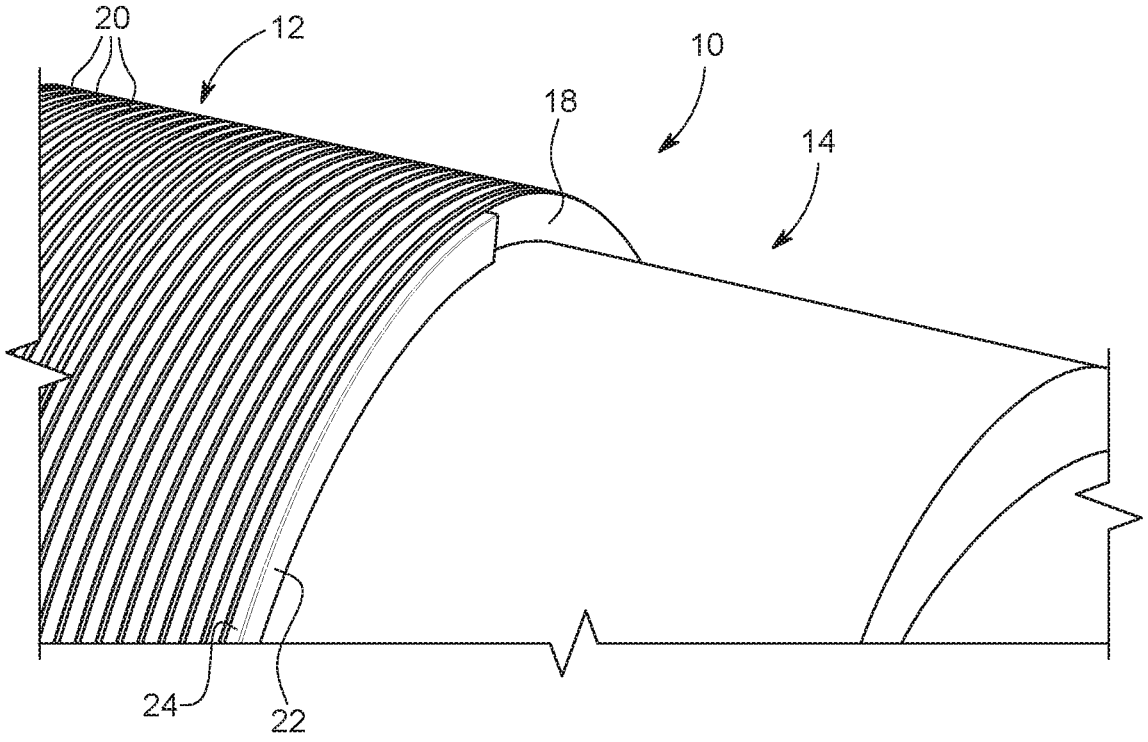
FIG. 1 is a perspective view of a first embodiment of a screen jacket termination configuration as disclosed herein.

Referring to FIG. 1, a perspective view of a screen jacket termination configuration 10 is illustrated. It will be appreciated by one of ordinary skill in the art that no end ring is present and yet the screen jacket 12 is both secure and sand tight at an end 14 thereof between jacket 12 and a base pipe 16 upon which the jacket 12 is disposed. "Sand tight" refers to a space that is smaller than a gauge of the screen jacket. "Gauge" of the screen jacket refers to the spacing between adjacent wraps of screen wire. Accordingly, a particular gauge of screen will filter a particular size of particle. A screen whose end is made sand tight is considered to not allow sand particles larger than those filtered by the body of the screen jacket to get in at the end. Sand tight at the end of the screen jacket can therefore be anywhere from completely fluid exclusive to allowing passage of fluid and particulates up to just under the size of particle that could flow through the screen jacket body.

Affording this condition, in the embodiment of FIG. 1, is a termination strip 18 that is wound about the base pipe 16 for several wraps of jacket wire 20. In an embodiment, the termination strip 18 is wrapped about the base pipe 16 fifteen times as shown in FIG. 1. More or fewer wraps of termination strip 18 may be selected for various needs. In an embodiment, the strip 18 may have an "L" shaped cross section comprising a web 22 and a flange 24. Too, however, a majority of the benefits of the disclosures herein may be achieved with the strip being only the radially outwardly extending portion of the strip 18 or in other words, just the web 22, i.e. the same strip 18 but without the flange 24 of the capital "L". In either case, the screen jacket will be rendered secure and sand tight between the base pipe 16 and the jacket 12. Further, it is to be appreciated that other geometric shapes for the cross section of the strip 18 are also contemplated such as but not limited to "T", "U", "V", etc.

Figure 2:
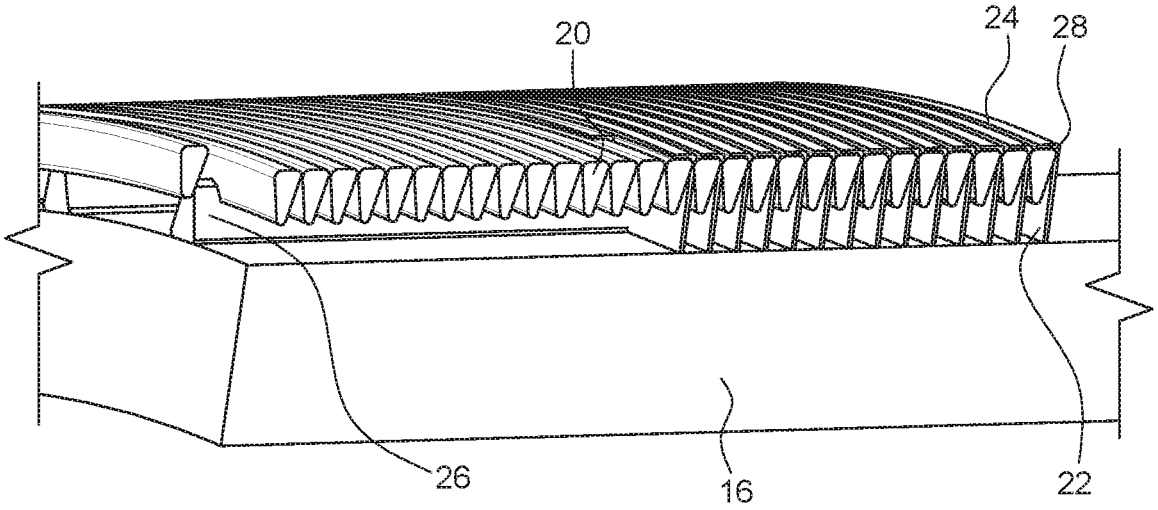
FIG. 2 is a perspective view of the embodiment of FIG. 1 but shown in cross section to illustrate one of the termination member geometries.

Referring to FIG. 2, greater understanding may be had. The view is a cross section of the configuration 10 taken adjacent a rib 26 of the ultimate screen. Those of skill in the art will recognize the rib 26, wire 20 and base pipe 16 as well known. Also known is the common method for manufacturing screens of this type with electric resistance welding. Many screens are currently fabricated in this way such that a specific discussion thereof is not necessary. New though is the termination strip 18 that is wound about the base pipe 16 and ribs 26 between wraps of wire 20. In an embodiment, the termination strip 18 may be deployed from another reel (not shown) into the configuration 10. In an embodiment, the termination strip 18 is electric resistance welded to the wire 20 at a radially outward portion thereof such as an edge 24 (if the embodiment has no flange) or flange 24. The web 22 is always welded (for example electric resistance welded) to the ribs 26 at least close enough to the base pipe 16 to leave a gap no larger than the screen gauge or in some embodiments, the web 22 will actually contact the base pipe 16. The termination strip 18 provides restraint to the wire 20 of the screen jacket 12 and also ensures there is no sand path from an end of the jacket to the filtered volume under the jacket 12. In embodiments where the termination strip 18 does not include the flange, it may be desirable to slightly increase a radial dimension of the strip 18 so that it radially protrudes from the jacket 12 to enhance the electric resistance welding process.

Figure 3:
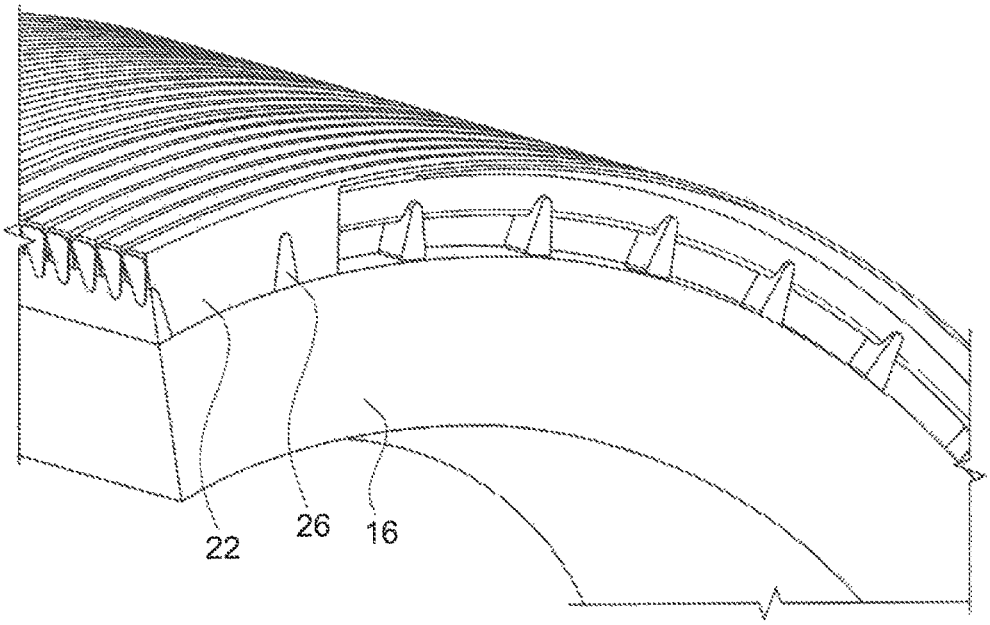
FIG. 3 is a cutaway perspective view of the embodiment of FIG. 1 illustrating the weld areas.

Referring to FIG. 3, the sand tightness of the configuration 10 is made clear by removing a section of web 22 so that portions of the configuration otherwise behind that web 22 are visible. One will recognize the wire 20 welded into the ribs 26 and can in this view see how the web 22 will form itself around the ribs 26 during the welding process. The entire outline of the rib 26 is accordingly fused to the web 22. The view also illustrates the web 22 either very close to the base pipe 16 or in contact therewith. All that is necessary is that any gap at that interface is no greater than the gauge of the screen being manufactured.

Figure 4:
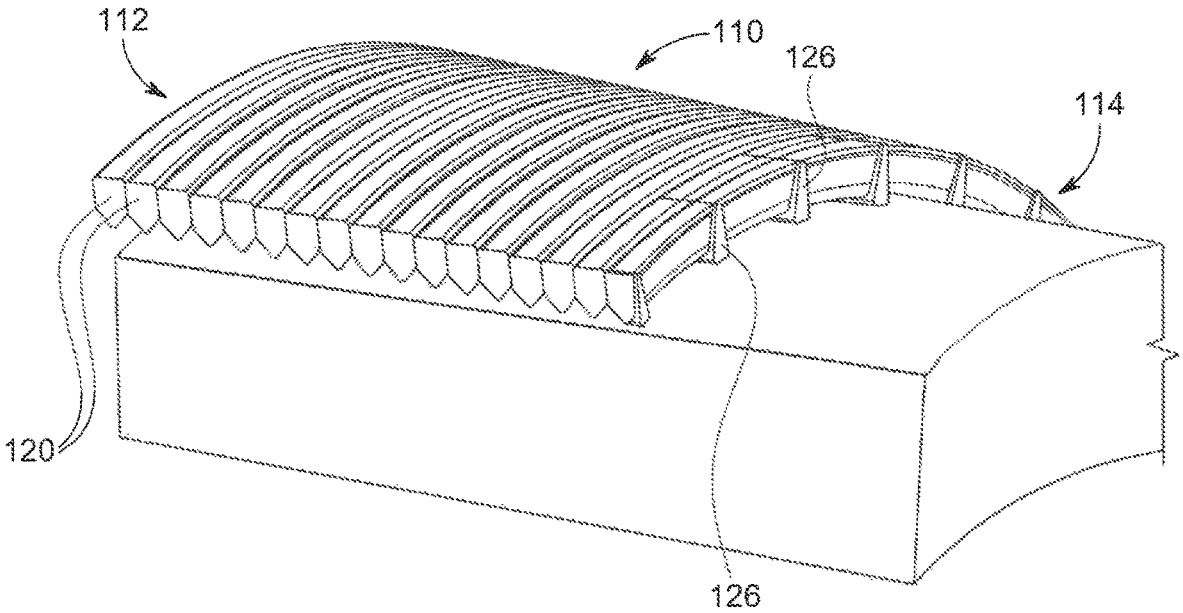
FIG. 4 is a perspective view of an alternative embodiment of a screen jacket termination configuration.

In an alternative embodiment of a screen jacket termination configuration 110, referring to FIG. 4, the result of a sand tight end 114 of a screen jacket 112 is still achieved and still without the need for an end ring. As one of skill in the art is familiar, an electric resistance weld is created by using applied electric current and force on parts to be welded. Resistance to the flowing current at the interface of the parts to be welded causes heat to rise, which increases resistance more, which then causes heat to continue to rise until the base material melt and fuse. The amount of force placed on the parts to be welded along with the current applied will dictate how deeply the parts will flow into one another. In the FIG. 4 embodiment, the inventor hereof has used a common screen manufacture paradigm for the majority of the screen jacket 112 and then has increased the force and/or current applied to wires 120 and ribs 126 to produce the configuration 110. By doing so, the wires 120 move much more deeply into the ribs 126 such that the wires themselves produce a gap at the base pipe 116 that is no greater than the gauge of the screen or actually come into contact with the base pipe 116. Because the increase in force and/or current is incremental as the screen is being formed the screen jacket 112 with exhibit an increasingly narrower diameter from a selected location on the jacket 112 to the end 114 of the jacket. This ensures that both the gauge between adjacent wraps of wire 120 and the end 114 will remain within specifications for the particular screen. The actual fused areas are very similar to the traditional part of the screen jacket but are deeper to effect the benefits of the disclosure.

In another iteration of the embodiment of FIG. 4, the ribs 126 may be tapered at intended end sections thereof such that the wire 120 will naturally become closer to the base pipe 116 without the need for increased force or electrical current. The end result of the wire being ultimately spaced from the base pipe 116 by no more than a gauge of the screen still applies.

Set forth below are some embodiments of the foregoing disclosure:

Embodiment 1

A screen jacket termination configuration including a base pipe, a rib disposed at the base pipe, a wire wrapped about the base pipe and rib to form a screen jacket, and a termination strip wrapped about the base pipe and rib and disposed between wraps of the wire.

Embodiment 2

The configuration as in any prior embodiment, wherein the termination strip comprises a web.

Embodiment 3

The configuration as in any prior embodiment, wherein the termination strip comprises a web and a flange.

Embodiment 4

The configuration as in any prior embodiment, wherein the web and flange are at included angle in a range of 80 to 100 degrees.

Embodiment 5

The configuration as in any prior embodiment, wherein a proximity between the termination strip and the base pipe ranges between contact and a gap not exceeding a selected gauge for the screen jacket.

Embodiment 6

The configuration as in any prior embodiment, wherein the termination strip is welded to the rib.

Embodiment 7

The configuration as in any prior embodiment, wherein the termination strip is welded to the wire of the screen jacket.

Embodiment 8

The configuration as in any prior embodiment, wherein the termination strip includes a flange welded to the wire of the screen jacket.

Embodiment 9

A screen jacket termination configuration including a base pipe, a rib disposed at the base pipe, a wire wrapped about the base pipe and rib to form a screen jacket, the wire having a first gap from the base pipe and being gradually reduced in a dimension of the gap from the base pipe from a more central position on the screen jacket to an end of the screen jacket.

Embodiment 10

The configuration a as in any prior embodiment, wherein the end of the screen jacket is defined by the wire-to-base pipe gap being no more than a gauge of the screen jacket.

Embodiment 11

The configuration as in any prior embodiment, wherein the reduced distance is by deeper fusing of the wire with the rib.

Embodiment 12

A method for terminating a screen jacket includes disposing a termination strip between adjacent wraps of a screen jacket, the termination strip closing a space between the screen jacket and a base pipe at an end of the screen jacket such that any gap between the termination strip and the base pipe is less than a gauge of the screen jacket.

Embodiment 13

The method as in any prior embodiment, further including welding the termination strip to the screen jacket.

Embodiment 14

A method for terminating a screen jacket including gradually reducing a gap between a wire wrap of the screen jacket and a base pipe until the dimension of the gap is no greater than a gauge of the screen jacket.

Embodiment 15

The method as in any prior embodiment, wherein the reducing is by more deeply fusing the wire to a rib.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A screen jacket termination configuration comprising:

a base pipe;

a rib disposed at the base pipe;

a wire wrapped about the base pipe and rib to form a screen jacket, the wire having a first radial gap from the base pipe and being gradually reduced in a radial dimension of the gap from the base pipe from a more central position on the screen jacket to an end of the screen jacket wherein the reduced distance is by deeper fusing of the wire with the rib.

2. The configuration as claimed in claim 1 wherein the end of the screen jacket is defined by the wire-to-base pipe gap being no more than a gauge of the screen jacket.

3. A method for terminating a screen jacket comprising:

gradually reducing a radial gap between a wire wrap of the screen jacket and a base pipe from a more central position on the screen jacket to an end of the screen jacket wherein the reducing is by more deeply fusing the wire to a rib.

* * * * *